US009745888B2

(12) United States Patent
Lee

(10) Patent No.: US 9,745,888 B2
(45) Date of Patent: Aug. 29, 2017

(54) ENGINE SYSTEM HAVING COOLANT CONTROL VALVE

(71) Applicant: Hyundai Motor Company, Seoul (KR)

(72) Inventor: HyoJo Lee, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 154 days.

(21) Appl. No.: 14/737,285

(22) Filed: Jun. 11, 2015

(65) Prior Publication Data

US 2016/0123218 A1 May 5, 2016

(30) Foreign Application Priority Data

Oct. 29, 2014 (KR) ..... 10-2014-0148303

(51) Int. Cl.

| | |
|---|---|
| ***F01P 7/16*** | (2006.01) |
| ***F01P 5/10*** | (2006.01) |
| ***F01P 11/04*** | (2006.01) |
| ***F01P 3/02*** | (2006.01) |
| *F01P 7/14* | (2006.01) |

(52) U.S. Cl.

CPC ..... *F01P 7/165* (2013.01); *F01P 2003/027* (2013.01); *F01P 2007/146* (2013.01); *F01P 2060/04* (2013.01); *F01P 2060/08* (2013.01); *F01P 2060/16* (2013.01)

(58) Field of Classification Search

CPC ..... F01P 7/165; F01P 7/16; F01P 7/14; F01P 7/00; F01P 5/10; F01P 3/00; F01P 3/02; F01P 3/04; F01P 3/12; F01P 3/20; F01P 2007/146; F01P 2060/04; F01P 2060/08; F01P 2060/16; F01P 2003/027

See application file for complete search history.

(56) References Cited

U.S. PATENT DOCUMENTS

| | | | | |
|---|---|---|---|---|
| 7,047,915 | B2 * | 5/2006 | Kawai | F01P 3/02 123/41.79 |
| 7,207,298 | B2 * | 4/2007 | Lee | F01P 7/165 123/41.05 |
| 7,721,683 | B2 * | 5/2010 | Lutz | F01P 3/02 123/41.1 |

(Continued)

FOREIGN PATENT DOCUMENTS

| | | | |
|---|---|---|---|
| JP | 10103053 A | * | 4/1998 |
| JP | 2010-43555 A | | 2/2010 |

(Continued)

*Primary Examiner* — Grant Moubry

(74) *Attorney, Agent, or Firm* — Morgan, Lewis & Bockius LLP

(57) ABSTRACT

An engine system having a coolant control valve may include a cylinder head including an intake side head coolant jacket for cooling an intake side thereof and an exhaust side head coolant jacket for cooling an exhaust side thereof formed in the cylinder head, a cylinder block arranged on a lower side of the cylinder head and having an intake side block coolant jacket for cooling an intake side of the cylinder block and an exhaust side block coolant jacket for cooling an exhaust side cylinder block formed therein, and a coolant control valve arranged for independently controlling coolant flowing through the intake side head coolant jacket, the exhaust side head coolant jacket, the intake side block coolant jacket and the exhaust side block coolant jacket.

4 Claims, 9 Drawing Sheets

(56) References Cited

U.S. PATENT DOCUMENTS

| | | | | |
|---|---|---|---|---|
| 7,912,599 | B2 * | 3/2011 | Eiraku | F01P 5/04 123/41.02 |
| 7,966,978 | B2 * | 6/2011 | Maehara | F02D 13/06 123/198 DB |
| 8,181,610 | B2 * | 5/2012 | Dipaola | F01P 7/165 123/41.01 |
| 8,464,668 | B2 * | 6/2013 | DiPaola | F01P 7/165 123/196 AB |
| 8,479,691 | B1 * | 7/2013 | Taylor | F01P 3/202 123/41.29 |
| 8,555,825 | B2 * | 10/2013 | Lenz | F01P 3/02 123/193.3 |
| 8,739,745 | B2 * | 6/2014 | Quix | F01P 7/165 123/41.02 |
| 8,746,187 | B2 * | 6/2014 | Nogawa | F01P 3/02 123/41.82 R |
| 8,763,566 | B1 * | 7/2014 | Taylor | F01P 3/202 123/41.29 |
| 9,212,620 | B2 * | 12/2015 | Berkemeier | F02F 1/243 |
| 9,273,591 | B2 * | 3/2016 | DiPaola | F01P 7/165 |
| 2013/0160723 | A1 * | 6/2013 | Miyagawa | F01P 7/16 123/41.1 |
| 2013/0247847 | A1 * | 9/2013 | Nogawa | F01P 3/02 123/41.34 |

FOREIGN PATENT DOCUMENTS

| | | | |
|---|---|---|---|
| JP | 2013-177843 | A | 9/2013 |
| KR | 10-1996-0012124 | B1 | 9/1996 |

* cited by examiner

ENGINE SYSTEM HAVING COOLANT CONTROL VALVE

CROSS-REFERENCE TO RELATED APPLICATION

The present application claims priority to Korean Patent Application Number 10-2014-0148303 filed Oct. 29, 2014, the entire contents of which is incorporated herein for all purposes by this reference.

BACKGROUND OF THE INVENTION

Field of the Invention

The present invention relates to an engine system having a coolant control valve which may control a coolant flow through both an exhaust side and intake side of a cylinder block and a cylinder head for improving cooling efficiency and reducing fuel consumption.

Description of Related Art

An engine generates torque by burning fuel, and remaining energy is discharged as thermal energy. Particularly, the coolant absorbs the thermal energy as the coolant circulates through an engine, a heater, and a radiator, and discharges the heat outside of the engine.

If a coolant temperature of the engine is low, oil viscosity is high, frictional force and fuel consumption increases, and a temperature of exhaust gas rises slowly, extending a time period for catalyst activation, making a quality of the exhaust gas poor. Along with this, if the coolant temperature of the engine is low, a time period required for normalizing a function of the heater is extended, making occupants and a driver feel cold.

If the coolant temperature of the engine is excessive, knocking takes place, and if ignition timing is adjusted for suppressing the knocking, performance may become poor. If a lubricant temperature is excessive, lubrication may become poor.

Consequently, one coolant control valve has been applied for controlling a plurality of cooling elements with one valve, to maintain the coolant temperature high at a particular region, to maintain the coolant temperature low at other particular regions, and so on.

Of the plurality of cooling elements, the cylinder block and the cylinder head are important elements, and technologies for separately cooling the cylinder block and the cylinder head are being researched.

The cylinder block and the cylinder head have intake sides for drawing in comparatively low temperature outdoor air and exhaust sides for exhausting comparatively high temperature exhaust gas, and researches are ongoing for individually controlling temperatures of the exhaust sides and the intake sides to improve cooling efficiency and reduce fuel consumption.

The above information disclosed in this Background section is only for enhancement of understanding of the background of the invention and therefore it may contain information that does not form the prior art that is already known in this country to a person of ordinary skill in the art.

BRIEF SUMMARY

Various aspects of the present invention are directed to providing an engine system having a coolant control valve having advantages of improved cooling efficiency and reduced fuel consumption.

Various aspects of the present invention are directed to providing an engine system having a coolant control valve, in which a cylinder head and a cylinder block are cooled separately from each other, and intakes sides and exhaust sides of the cylinder head and the cylinder block are cooled separately from each other, for improving cooling efficiency and reducing fuel consumption.

According to various aspects of the present invention, an engine system having a coolant control valve may include a cylinder head including an intake side head coolant jacket for cooling an intake side thereof and an exhaust side head coolant jacket for cooling an exhaust side thereof formed in the cylinder head, a cylinder block arranged on a lower side of the cylinder head and having an intake side block coolant jacket for cooling an intake side of the cylinder block and an exhaust side block coolant jacket for cooling an exhaust side cylinder block formed therein, and a coolant control valve arranged for independently controlling coolant flowing through the intake side head coolant jacket, the exhaust side head coolant jacket, the intake side block coolant jacket and the exhaust side block coolant jacket.

The engine system may further include a coolant pump for pumping the coolant to flow through the cylinder head and the cylinder block, in which the coolant pump may be arranged on an inlet side through which the coolant is introduced into the cylinder head and the cylinder block, and the coolant control valve may be arranged on an outlet side through which the coolant is discharged from the cylinder head and the cylinder block.

The coolant supplied to the coolant control valve through the cylinder block and the cylinder head may be supplied to a heater core for cabin heating, an Exhaust Gas Recirculation (EGR) cooler for cooling recycling exhaust gas, a radiator for dispersing heat to the outside, and an oil cooler for controlling an oil temperature, and the coolant control valve may control the coolant to be supplied to the heater core, the EGR cooler, the radiator, and the oil cooler, respectively and independently.

The intake side head coolant jacket and the exhaust side head coolant jacket may be configured to be separated from each other by a partition wall, and the intake side block coolant jacket and the exhaust side block coolant jacket may be configured to be separated from each other by a partition wall.

A temperature of the coolant passing through the cylinder head or the cylinder block may be detected, and the coolant control valve may be configured to be controlled according to the detected temperature of the coolant.

The coolant control valve may be configured to be controlled to block the coolant flowing through the intake side head coolant jacket, the exhaust side head coolant jacket, the intake side block coolant jacket, and the exhaust side block coolant jacket according to the detected temperature of the coolant.

The coolant control valve may be configured to be controlled such that the coolant flows through the intake side head coolant jacket, and the coolant flowing through the exhaust side head coolant jacket, the intake side block coolant jacket, and the exhaust side block coolant jacket may be blocked according to the detected temperature of the coolant.

The coolant control valve may be configured to be controlled such that the coolant flows through the intake side head coolant jacket and the exhaust side head coolant jacket, and the coolant flowing through the intake side block coolant jacket and the exhaust side block coolant jacket may be blocked according to the detected temperature of the coolant.

The coolant control valve may be configured to be controlled such that the coolant flows through the intake side head coolant jacket, the exhaust side head coolant jacket, and the intake side block coolant jacket, and the coolant flowing through the exhaust side block coolant jacket may be blocked according to the detected temperature of the coolant.

The coolant control valve may be configured to be controlled such that the coolant flows through the intake side head coolant jacket, the exhaust side head coolant jacket, the intake side block coolant jacket, and the exhaust side block coolant jacket according to the detected temperature of the coolant.

The coolant control valve may include a cylindrical valve of a pipe shape with at least one opened side, having a coolant passage in fluid communication from a center portion thereof to an outside surface thereof, a valve housing having an inside circumference matched to an outside circumference of the cylindrical valve, the cylindrical valve rotatably arranged therein, and the intake side head coolant jacket, the exhaust side head coolant jacket, the intake side block coolant jacket, and the exhaust side block coolant jacket connected thereto, and a driving unit for rotating the cylindrical valve such that the coolant passage in the cylindrical valve is connected to the intake side head coolant jacket, the exhaust side head coolant jacket, the intake side block coolant jacket, or the exhaust side block coolant jacket depending on rotated positions of the coolant passage for making the coolant flow therethrough.

According to the present invention for achieving the object, the intake side and the exhaust side of the cylinder head and the intake side and the exhaust side of the cylinder block are respectively cooled according to a driving condition for improving cooling efficiency and enabling control of the engine temperature.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
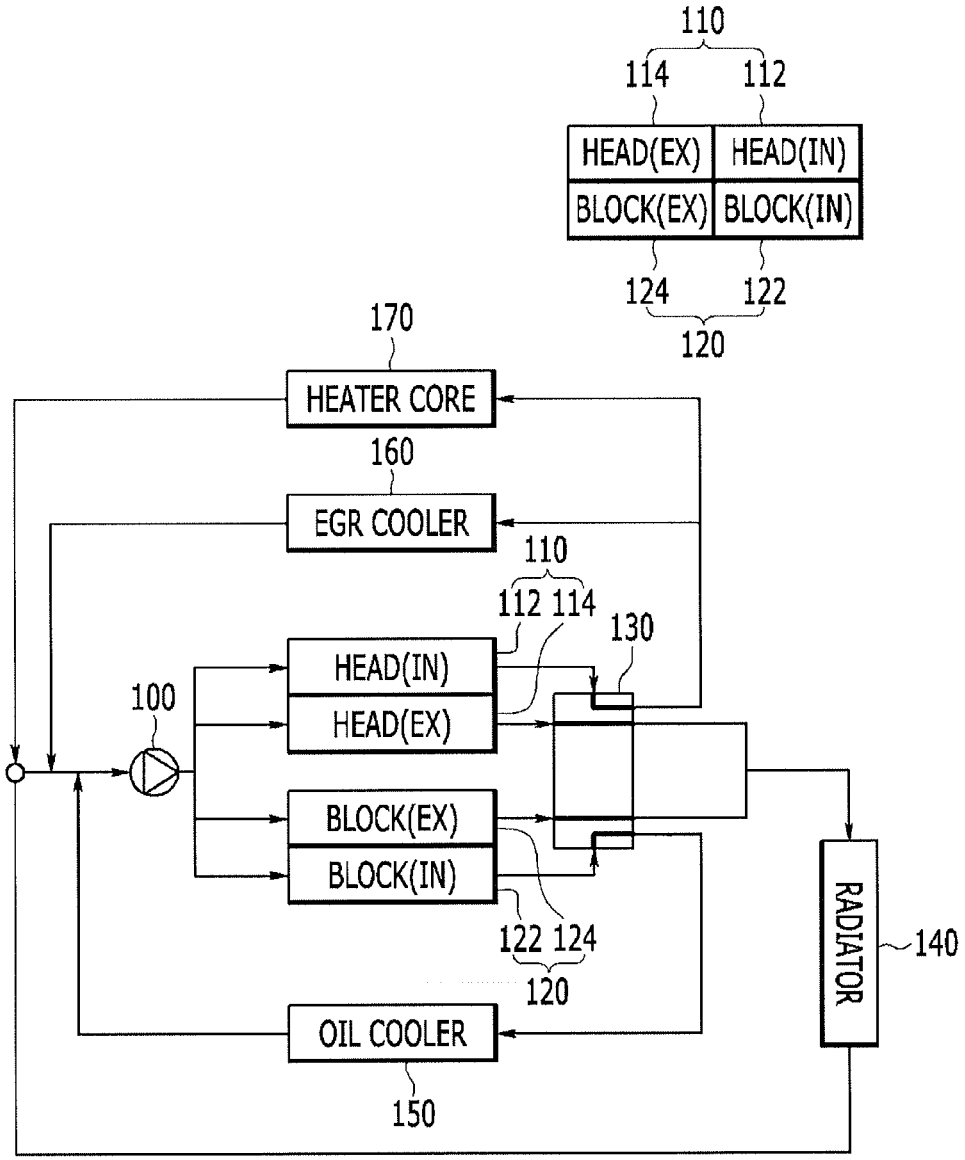
FIG. 1 illustrates a block diagram of coolant flows throughout an engine system having a coolant control valve in accordance with a preferred embodiment of the present invention.

FIG. 1 illustrates a block diagram of coolant flows throughout an engine system having a coolant control valve in accordance with various embodiments of the present invention.

Referring to FIG. 1, the engine system includes a cylinder block 120, a cylinder head 110, a coolant control valve 130, a coolant pump 100, a heater core 170, an EGR cooler 160, a radiator 140 and an oil cooler 150, the cylinder block 120 includes an cylinder block intake side 122 and an cylinder block exhaust side 124, and the cylinder head 110 includes an cylinder head intake side 112 and an cylinder head exhaust side 114.

The coolant pump 100 pumps the coolant toward the cylinder block 120 and the cylinder head 110, and the coolant control valve 130 controls the coolant discharged from the cylinder block 120 and the cylinder head 110 respectively, to distribute the coolant to the heater core 170, the EGR cooler 160, the radiator 140, and the oil cooler 150.

The coolant control valve 130 controls the coolant passing through the cylinder head intake side 112, the cylinder head exhaust side 114, the cylinder block intake side 122, and the cylinder block exhaust side 124, respectively, and controls the coolant being distributed to the heater core 170, the EGR cooler 160, the radiator 140, and the oil cooler 150.

The heater core 170 performs a function for heating cabin air of a vehicle by using heated coolant, the EGR cooler 160 cools down recycling exhaust gas (EGR gas) recycling from an exhaust line to an intake line, the oil cooler 150 cools down an oil circulating through the engine, and the radiator 140 performs dispersion of heat from high temperature coolant to outside of the vehicle.

The cylinder head intake side 112 and the cylinder head exhaust side 114 have an intake side head coolant jacket 412 and an exhaust side head coolant jacket 414 formed therein, respectively, and the cylinder block intake side 122 and the cylinder block exhaust side 124 have an intake side block coolant jacket 402 and an exhaust side block coolant jacket 404 formed therein, respectively.

In various embodiments of the present invention, the intake side head coolant jacket 412 and the exhaust side head coolant jacket 414 may be separated with a partition wall or connected with a passage, and the intake side block coolant jacket 402 and the exhaust side block coolant jacket 404 may be separated with a partition wall or connected with a passage.

Figure 2:
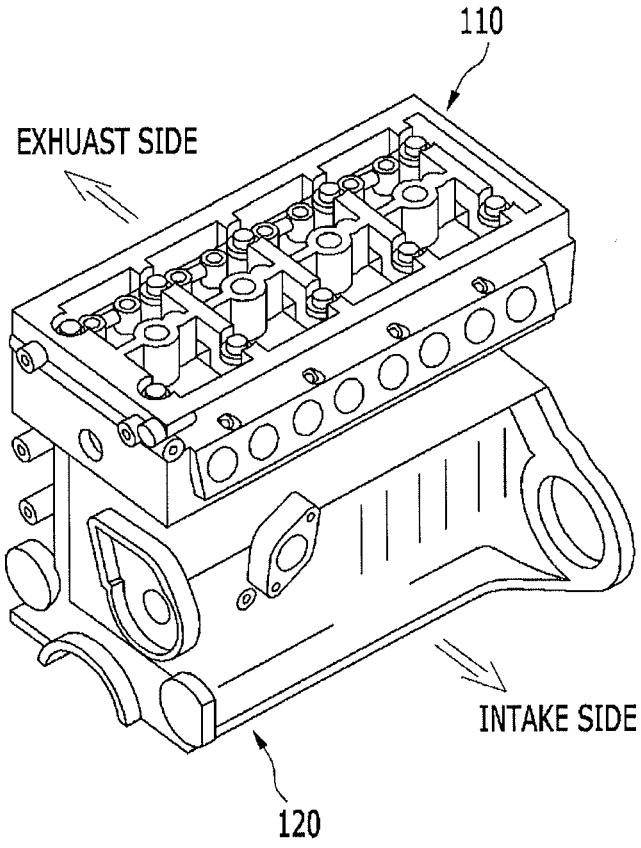
FIG. 2 illustrates a partial perspective view showing a cylinder block and a cylinder head in an engine system in accordance with a preferred embodiment of the present invention.

FIG. 2 illustrates a partial perspective view showing a cylinder block and a cylinder head in an engine system in accordance with various embodiments of the present invention.

Referring to FIG. 2, the cylinder block 120 is arranged on a lower side and the cylinder head 110 is arranged on an upper side of the cylinder block 120.

Intake sides of the cylinder head 110 and the cylinder block 120 are fastened to an intake manifold used for drawing in outdoor air, and exhaust sides of the cylinder head 110 and the cylinder block 120 are fastened to an exhaust manifold used for discharging exhaust gas.

Figure 3A:
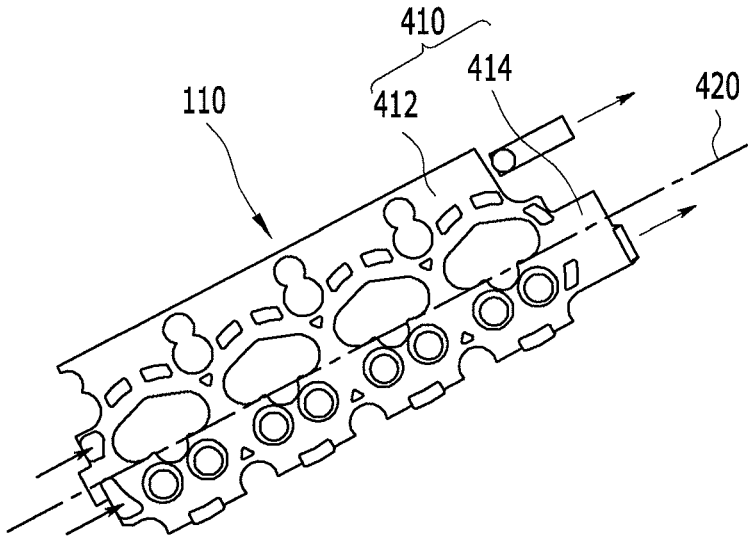
FIG. 3A and FIG. 3B illustrate a plan view and a perspective view of a coolant jacket formed in a cylinder block and a cylinder head in an engine system according to the present invention, respectively.
Figure 3B:
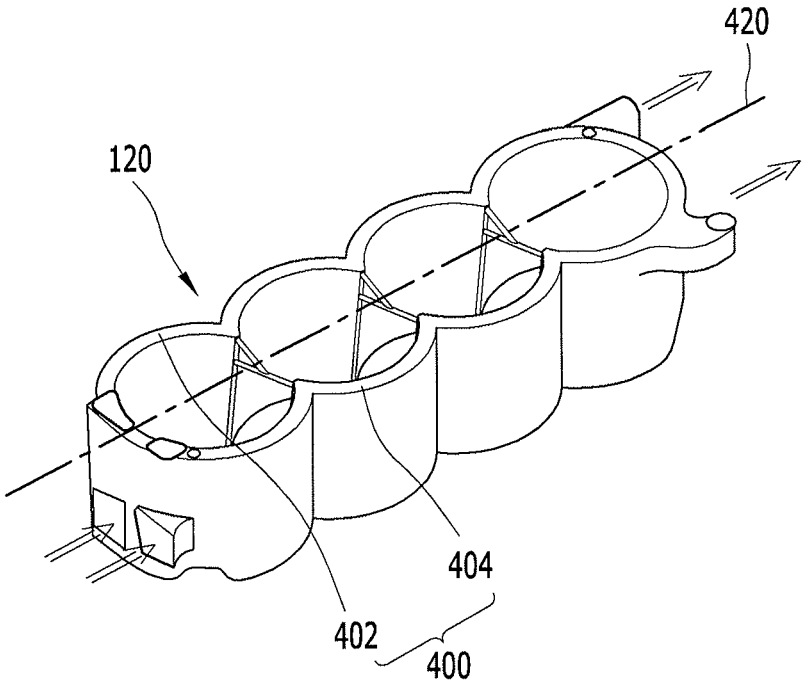

FIG. 3A and FIG. 3B illustrate a plan view and a perspective view of a coolant jacket formed in a cylinder block and a cylinder head in an engine system in accordance with various embodiments of the present invention, respectively.

Referring to FIG. 3A and FIG. 3B, the cylinder head 110 has a head coolant jacket 410 formed therein, and the head coolant jacket 410 may be separated into an intake side head coolant jacket 412 and an exhaust side head coolant jacket 414 with reference to a length direction center axis 420.

Further, the intake side head coolant jacket 412 has a coolant inlet and a coolant outlet formed on respective ends thereof, and the exhaust side head coolant jacket 414 has a coolant inlet and a coolant outlet formed on respective ends thereof.

The cylinder block 120 has a block coolant jacket 400 formed therein, and the block coolant jacket 400 may be separated to an intake side block coolant jacket 402 and an exhaust side block coolant jacket 404 with reference to the length direction center axis 420.

In addition, the intake side block coolant jacket 402 has a coolant inlet and a coolant outlet formed in respective ends thereof, and the exhaust side block coolant jacket 404 has a coolant inlet and a coolant formed in respective ends thereof.

In various embodiments of the present invention, if the coolant temperature of the engine is lower than a first temperature, the coolant control valve 130 blocks entire coolant flow, so as to not allow the coolant to flow to the cylinder head 110 and the cylinder block 120.

Figure 4:
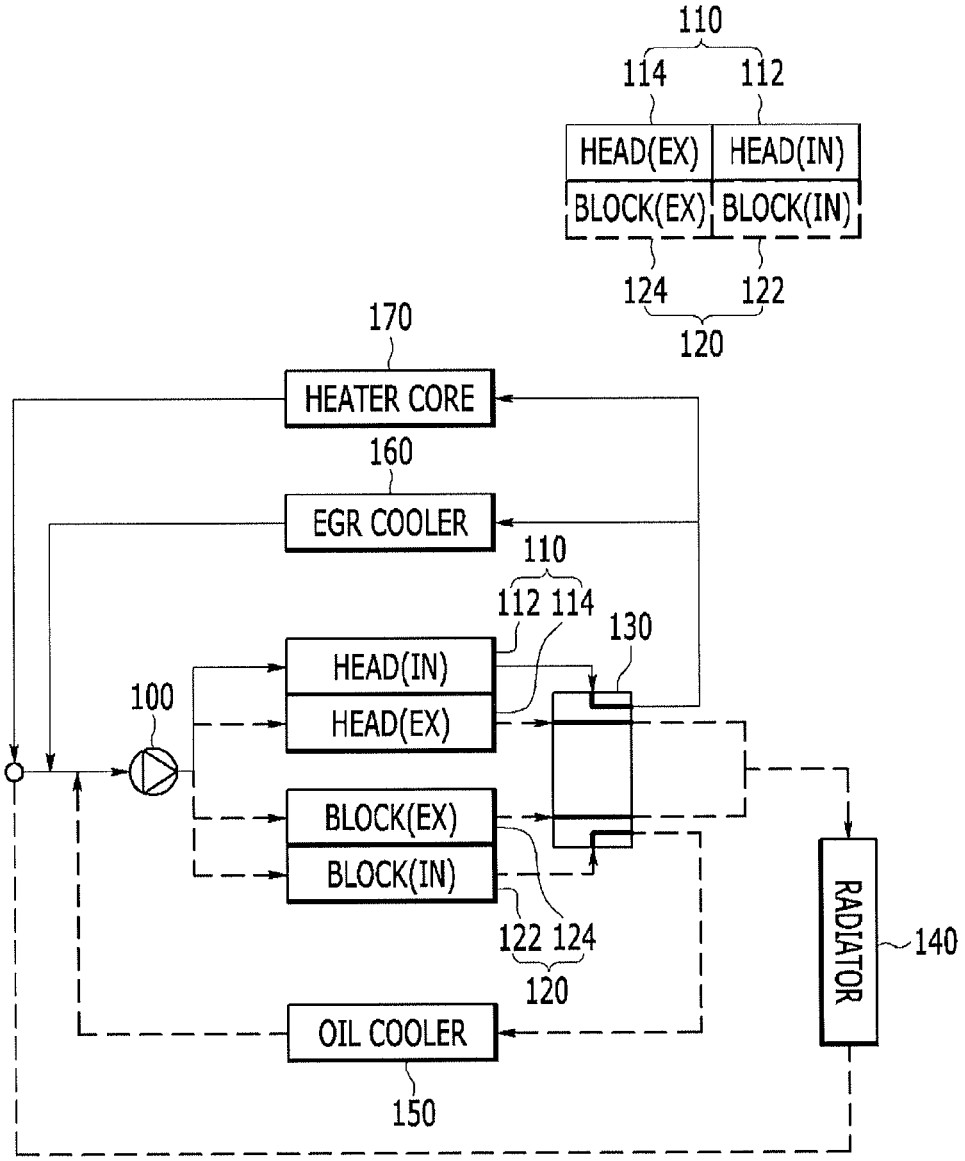
FIG. 4 illustrates a block diagram showing a coolant flow to an intake side of a cylinder block in an engine system according to the present invention.

FIG. 4 illustrates a block diagram showing a coolant flow to an intake side of a cylinder block in an engine system in accordance with various embodiments of the present invention.

Referring to FIG. 4, if the coolant temperature of the engine is between the first temperature and a second temperature which is higher than the first temperature, the coolant control valve 130 opens a flow passage to the cylinder head intake side 112 of the cylinder head 110 to allow the coolant to pass through the cylinder head intake side 112.

The coolant flowing to the other areas, i.e., the cylinder head exhaust side 114, the cylinder block intake side 122, and the cylinder block exhaust side 124, is blocked.

Figure 5:
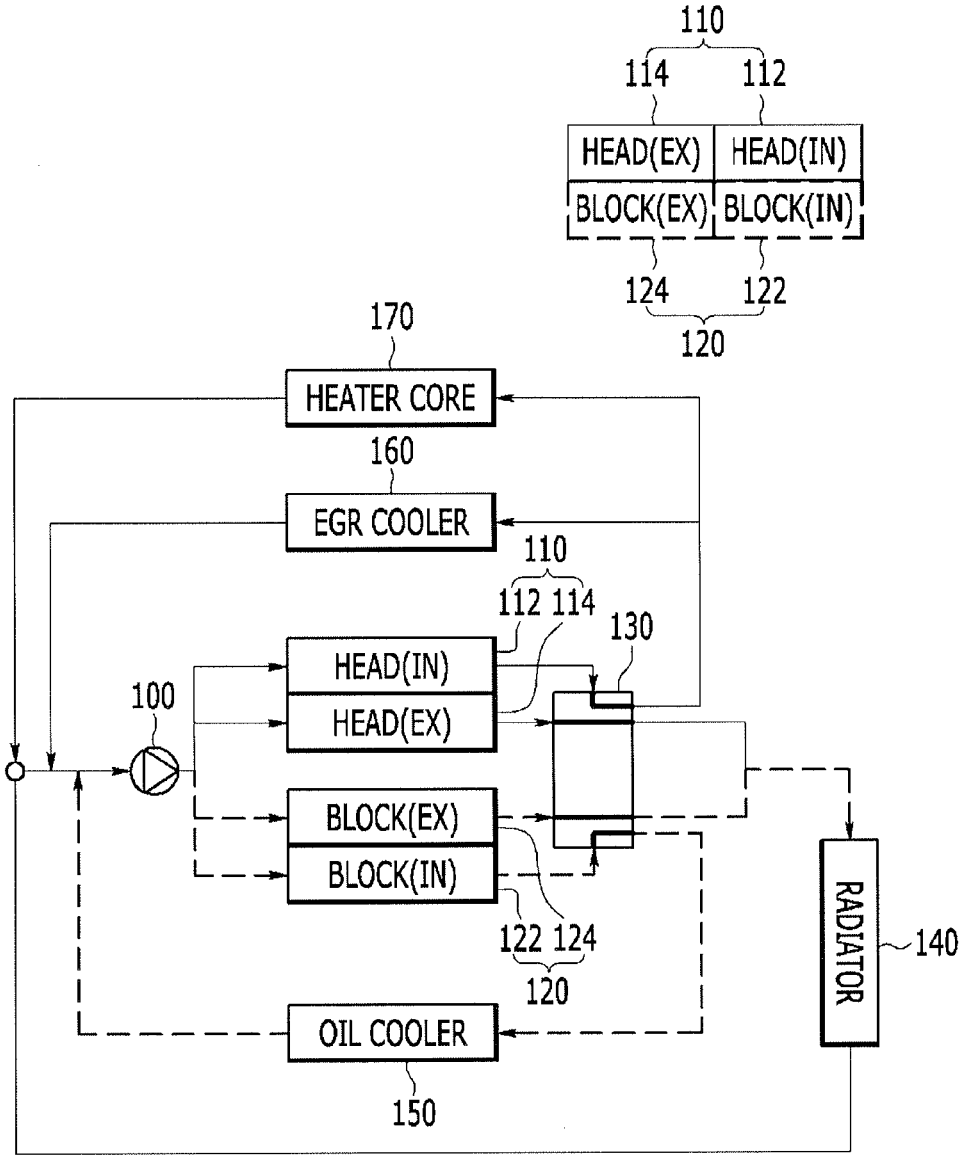
FIG. 5 illustrates a block diagram showing coolant flows to an intake side and an exhaust side of a cylinder head in an exemplary engine system according to the present invention.

FIG. 5 illustrates a block diagram showing coolant flows to an intake side and an exhaust side of a cylinder head in an engine system in accordance with various embodiments of the present invention.

Referring to FIG. 5, if the coolant temperature of the engine is between the second temperature and a third temperature higher than the second temperature, the coolant control valve 130 opens a flow passage to the cylinder head intake side 112 and the cylinder head exhaust side 114 of the cylinder head 110, to allow the coolant to pass through the cylinder head intake side 112 and the cylinder head exhaust side 114.

The coolant flowing to the other areas, i.e., the cylinder block intake side 122 and the cylinder block exhaust side 124, is blocked.

Figure 6:
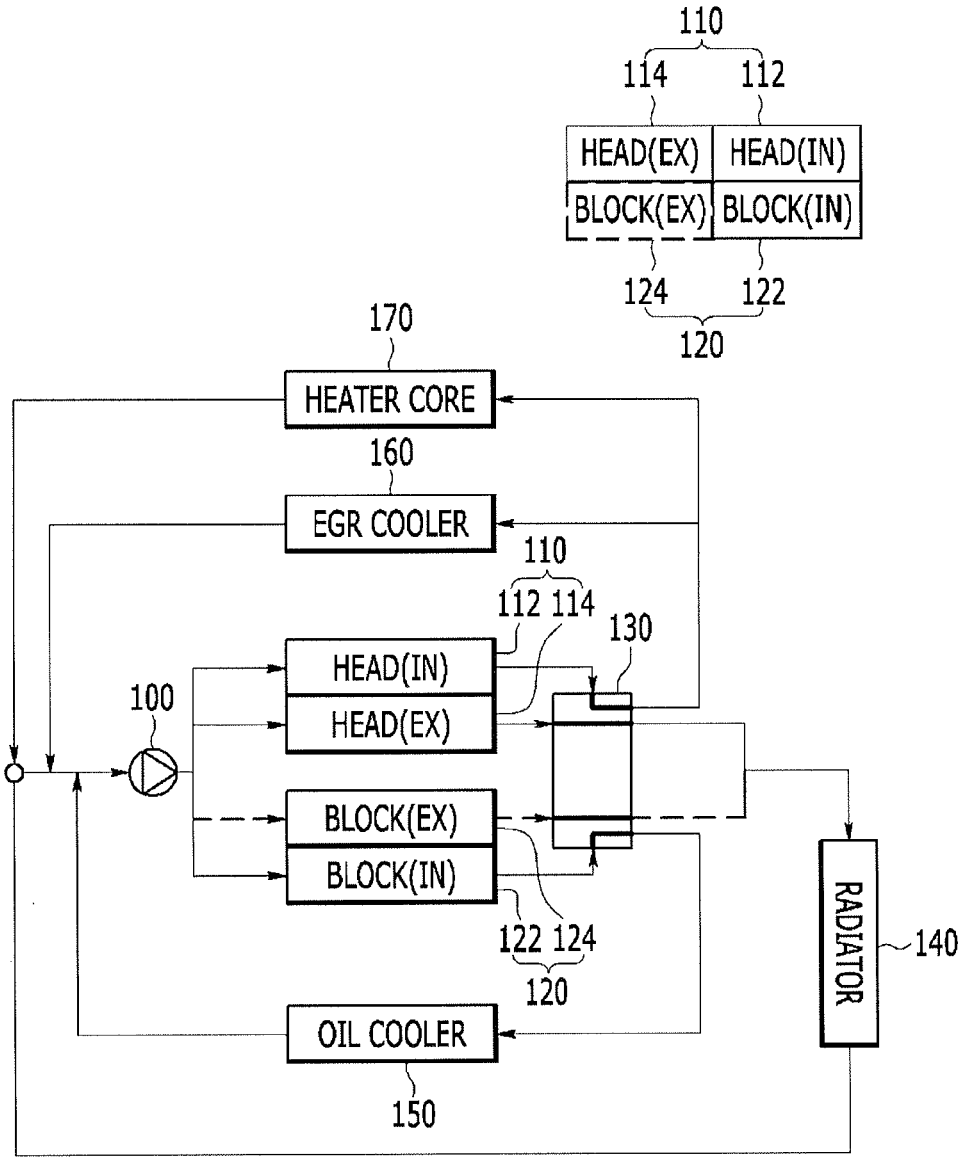
FIG. 6 illustrates a block diagram showing coolant flows to an intake side and an exhaust side of a cylinder block and an intake side of a cylinder block in an exemplary engine system according to the present invention.

FIG. 6 illustrates a block diagram showing coolant flows to an intake side and an exhaust side of a cylinder block and an intake side of a cylinder block in an engine system in accordance with various embodiments of the present invention.

Referring to FIG. 6, if the coolant temperature of the engine is between the third temperature and a fourth temperature higher than the third temperature, the coolant control valve 130 opens a flow passage to the cylinder head intake side 112 and the cylinder head exhaust side 114 of the cylinder head 110, and the cylinder block intake side 122, to allow the coolant to pass through the cylinder head intake side 112, the cylinder head exhaust side 114, and the cylinder block intake side 122.

The coolant flowing to the other area, i.e., the cylinder block exhaust side 124, is blocked.

Further, if the coolant temperature of the engine is between the fourth temperature and a fifth temperature higher than the fourth temperature, the coolant control valve 130 opens a flow passage to the cylinder head intake side 112 and the cylinder head exhaust side 114 of the cylinder head 110, and the cylinder block intake side 122 and the cylinder block exhaust side 124 of the cylinder block 120, to allow the coolant to pass through the cylinder head intake side 112, the cylinder head exhaust side 114, the cylinder block intake side 122, and the cylinder block exhaust side 124.

Figure 7:
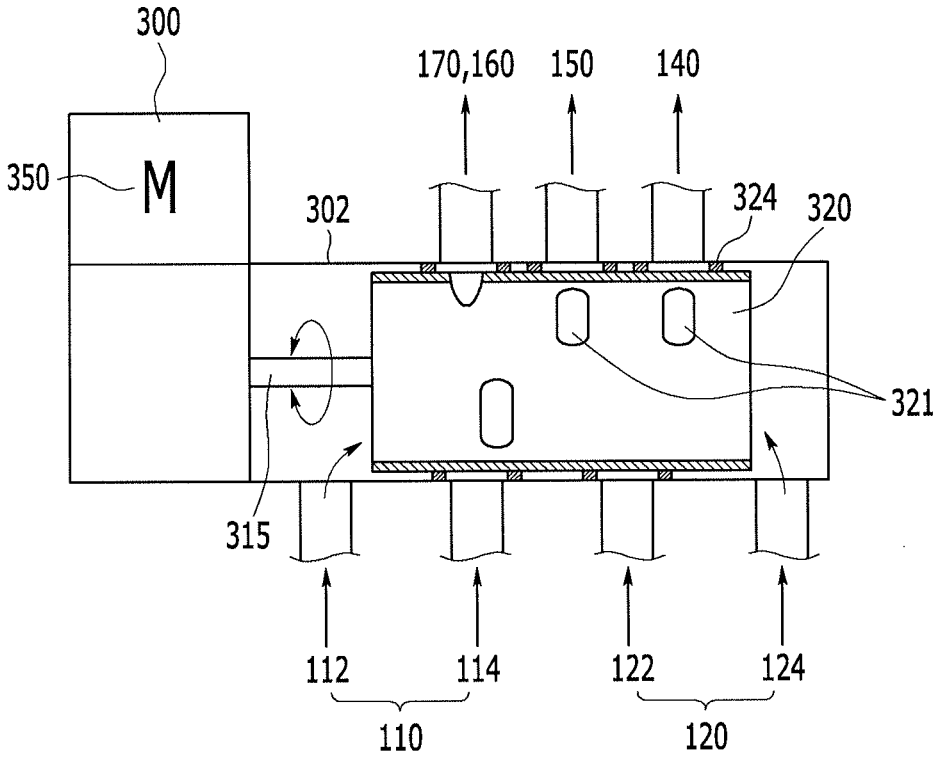
FIG. 7 schematically illustrates a partial cross-sectional view of a coolant control valve applicable to an exemplary engine system according to the present invention.

FIG. 7 illustrates a partial cross-sectional view of a coolant control valve applicable to an engine system in accordance with various embodiments of the present invention, schematically.

Referring to FIG. 7, the coolant control valve 130 includes a motor housing 300, a rotation shaft 315, a cylindrical valve 320, a valve housing 302, and a sealing member 324.

The cylindrical valve 320 has a hollow pipe structure with an outside circumference placed in an inside circumference of the valve housing 302. The cylindrical valve 320 has coolant passages 321 formed to be in communication from a center portion thereof to the outside circumference thereof, and the valve housing 302 has pipes formed thereon that are matched to the coolant passages 321.

The pipes have the coolant supplied thereto from the coolant jackets of the cylinder head intake side 112, the cylinder head exhaust side 114, the cylinder block intake side 122, and the cylinder block exhaust side 124, respectively, and distribute the coolant to the heater core 170, the EGR cooler 160, the oil cooler 150, and the radiator 140, respectively.

As shown, the coolant supplied from the cylinder head intake side 112 may be supplied to one end portion of the cylindrical valve 320 through the valve housing 302, and the coolant supplied from the cylinder block intake side 122 may be supplied to the other end portion of the cylindrical valve 320 through the valve housing 302.

The coolant supplied from the cylinder block exhaust side 124 and the cylinder head exhaust side 114 may be supplied to a center portion space of the cylindrical valve 320 through the valve housing 302 and the coolant passage 321 in the cylindrical valve 320, and the coolant supplied through the inlets at both ends of the cylindrical valve 320 and the coolant passage 321 is again supplied to the heater core 170, the EGR cooler 160, the oil cooler 150, and the radiator 140 through the coolant passage 321 and the valve housing 302.

In various embodiments of the present invention, the rotation shaft 315 is rotated by a motor mounted in the motor housing 302, and the rotation shaft 315 rotates the cylindrical valve 320, and as the coolant passages 321 of the cylindrical valve 320 are respectively matched with the pipes, the coolant flows.

Sealing members 324 are matched to the pipes between the valve housing 302 and the cylindrical valve 320, and the sealing members 324 form sealing structures between the outside circumference of the cylindrical valve 320 and the inside circumference of the valve housing 302, respectively.

Figure 8:
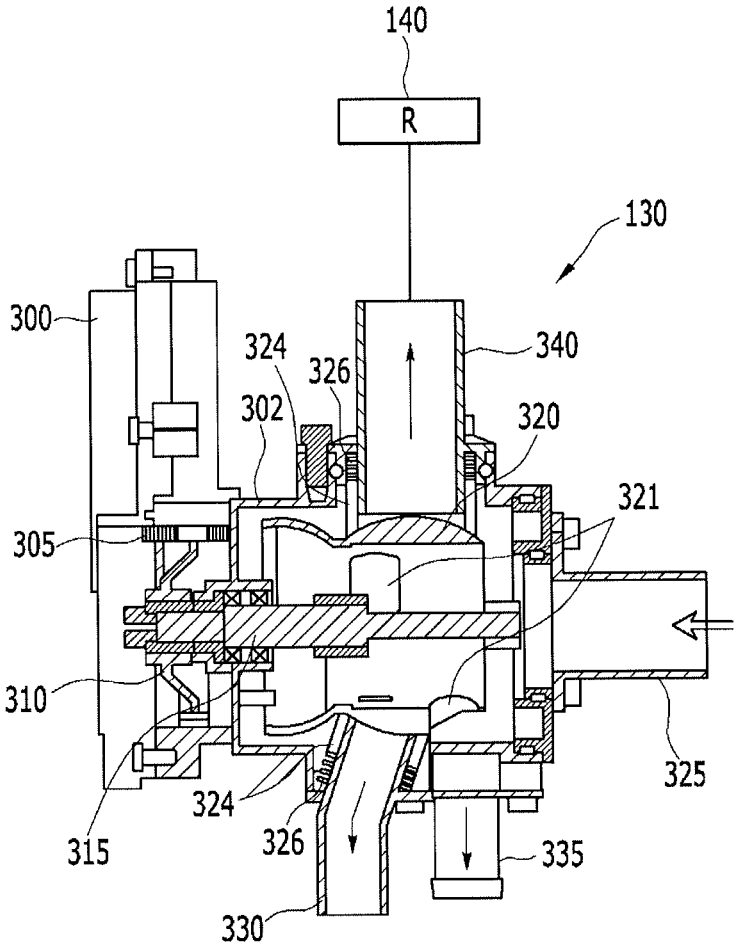
FIG. 8 schematically illustrates a partial cross-sectional view of a coolant control valve related to the present invention.

FIG. 8 schematically illustrates a partial cross-sectional view of a coolant control valve related to the present invention.

Referring to FIG. 8, the coolant control valve 130 includes a motor housing 300 having a built-in motor 350, an output gear 305 rotated by the motor, and a driven gear 310 rotated by the output gear 305, and the driven gear 310 is arranged to rotate the cylindrical valve 320.

The cylindrical valve 320 has a pipe shape with opened ends to have a center space in a length direction thereof. The cylindrical valve 320 has coolant passages 321 formed to be in communication from the center space to an outside surface.

The valve housing 302 with the cylindrical valve 320 mounted therein has one end with a first inlet pipe 325 arranged thereon and the other end with the motor housing 300 connected thereto. The valve housing 302 has a radiator supply pipe 340 connected to the radiator 140, a second inlet pipe 330 connected to the cylinder head 100, and a heater supply pipe 335 connected to the heater 150 arranged thereon.

The cylindrical valve 320 has a sealing member 324 arranged on an outside circumference thereof, a front end of the radiator supply pipe 340 inserted in the sealing member 324, and an elastic member 326 elastically pushing the sealing member 324 toward an outside circumference of the cylindrical valve 320, to form a sealing structure.

The control unit controls the motor in the motor housing 300 according to an operation condition, i.e., a coolant temperature or an intake air temperature, to rotate the cylindrical valve 320 with reference to the rotation shaft 315 arranged in a length direction center axis through the output gear 305 and the driven gear 310.

Further, if the passage 321 of the cylindrical valve 320 is matched to the first inlet pipe 325 or the second inlet pipe 330, the coolant is supplied.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine system having a coolant control valve, the engine system comprising:

a cylinder head including an intake side head coolant jacket for cooling an intake side thereof and an exhaust side head coolant jacket for cooling an exhaust side thereof formed in the cylinder head;

a cylinder block arranged on a lower side of the cylinder head and having an intake side block coolant jacket for cooling an intake side of the cylinder block and an exhaust side block coolant jacket for cooling an exhaust side cylinder block formed therein; and the coolant control valve arranged for independently controlling coolant flowing through the intake side head coolant jacket, the exhaust side head coolant jacket, the intake side block coolant jacket and the exhaust side block coolant jacket, wherein the intake side head coolant jacket is connected to a heater core and an Exhaust Gas Recirculation (EGR) cooler, wherein the exhaust side head coolant jacket and the exhaust side block coolant jacket are connected to a radiator; and wherein the intake side block coolant jacket is connected to an oil cooler, wherein the coolant supplied to the coolant control valve through the cylinder block and the cylinder head is supplied to the heater core for cabin heating, the EGR cooler for cooling recycling exhaust gas, the radiator for dispersing heat to the outside, and the oil cooler for controlling an oil temperature, and wherein the coolant control valve controls the coolant to be supplied to the heater core, the EGR cooler, the radiator, and the oil cooler, respectively and independently, wherein:

when a coolant temperature of an engine is lower than a first temperature, the coolant control valve blocks entire coolant flow, so as to not allow the coolant to flow to the cylinder head and the cylinder block, when the coolant temperature of the engine is between the first temperature and a second temperature which is higher than the first temperature, the coolant control valve opens a flow passage to the cylinder head intake side of the cylinder head, when the coolant temperature of the engine is between the second temperature and a third temperature higher than the second temperature, the coolant control valve opens a flow passage to the cylinder head intake side and the cylinder head exhaust side of the cylinder head, when the coolant temperature of the engine is between the third temperature and a fourth temperature higher than the third temperature, the coolant control valve opens a flow passage to the cylinder head intake side and the cylinder head exhaust side of the cylinder head, and the cylinder block intake side, and when the coolant temperature of the engine is between the fourth temperature and a fifth temperature higher than the fourth temperature, the coolant control valve opens a flow passage to the cylinder head intake side and the cylinder head exhaust side of the cylinder head, and the cylinder block intake side and the cylinder block exhaust side of the cylinder block.

2. The engine system of claim 1, further comprising:

a coolant pump for pumping the coolant to flow through the cylinder head and the cylinder block, wherein the coolant pump is arranged on an inlet side through which the coolant is introduced into the cylinder head and the cylinder block, and wherein the coolant control valve is arranged on an outlet side through which the coolant is discharged from the cylinder head and the cylinder block.

3. The engine system of claim 1, wherein the intake side head coolant jacket and the exhaust side head coolant jacket are configured to be separated from each other by a partition wall, and the intake side block coolant jacket and the exhaust side block coolant jacket are configured to be separated from each other by a partition wall.

4. The engine system of claim 1, wherein the coolant control valve includes:

a cylindrical valve of a pipe shape with at least one opened side, having a coolant passage in fluid communication from a center portion thereof to an outside surface thereof;

a valve housing having an inside circumference matched to an outside circumference of the cylindrical valve, the cylindrical valve rotatably arranged in the valve housing, and the intake side head coolant jacket, the exhaust side head coolant jacket, the intake side block coolant jacket, and the exhaust side block coolant jacket connected to the valve housing; and a driving unit for rotating the cylindrical valve, wherein the coolant passage in the cylindrical valve is connected to the intake side head coolant jacket, the exhaust side head coolant jacket, the intake side block coolant jacket, or the exhaust side block coolant jacket depending on rotated positions of the coolant passage for making the coolant flow therethrough.

* * * * *